United States Patent [19]

Meyer et al.

[11] 4,062,736

[45] Dec. 13, 1977

[54] GOLD AND GOLD ALLOY DEPOSITION

[75] Inventors: Andre R. Meyer; Salvatore Losi; Erwin Marka, all of Geneva; Jacques Rudio, Vesenex; Franco Zuntini, Geneva, all of Switzerland

[73] Assignee: Oxy Metal Industries Corporation, Warren, Mich.

[21] Appl. No.: 631,780

[22] Filed: Nov. 13, 1975

[30] Foreign Application Priority Data

Nov. 15, 1974 Switzerland ..... 15236/74

[51] Int. Cl.[2] ..... C25D 3/48; C25D 3/62

[52] U.S. Cl. ..... 204/43 G; 204/46 G

[58] Field of Search ..... 204/43 G, 46 G; 106/1

[56] References Cited

U.S. PATENT DOCUMENTS

| | | | |
|---|---|---|---|
| 3,642,589 | 2/1972 | Nobel et al. | 204/44 |
| 3,783,111 | 1/1974 | Bick et al. | 204/46 G |
| 3,878,066 | 4/1975 | Dettke et al. | 204/43 G |
| 3,878,068 | 4/1975 | Bick et al. | 204/46 G |

*Primary Examiner*—G. L. Kaplan

*Attorney, Agent, or Firm*—B. F. Claeboe; Richard P. Mueller; Arthur E. Kluegel

[57] ABSTRACT

Disclosed is a bath and process for obtaining deposits of gold or gold alloys of improved uniformity of deposit thickness on an irregularly shaped conductive surface. The aqueous plating bath contains gold as the aurocyanide complex, a mild reducing agent, a complexing agent, arsenic as a water-soluble arsenic compound, and a substituted polyamine.

4 Claims, No Drawings

GOLD AND GOLD ALLOY DEPOSITION

BACKGROUND OF THE INVENTION

The present invention concerns a bath for the electrodeposition of gold and alloys particularly suited for the coating of pieces having irregular surfaces.

The invention also concerns the use of such baths for coating pieces intended to be used in the electronic industry, for instance transistor and diode headers and other printed circuit components.

It is well known in the plating art that the coating of irregularly shaped pieces is plagued with problems related to the variety of shapes of the surfaces to be plated. Thus, local plating current density variations are experienced which depend on the good or bad accessibility of the areas in contact with the electrolyte. Thus, for instance, the projecting angles of such pieces are subjected to current densities higher than average, whereas densities are below average around recessed angles. With classical plating baths, such a situation will result in thick deposits on the easily reached zones and thin deposits on the recessed areas. Or, in other words, when one desires to obtain a coating of a minimum thickness on the most recessed areas, one will have to accept the formation of an unnecessarily thick deposit on the exposed areas which condition, in the case of gold, is economically unfavorable.

Such a situation becomes even more critical when the pieces to be plated are too small to be hooked on a plating rack and the parts must be placed in a plating barrel. In such case, the pieces which tumble over each other contact the cathode only intermittently which results in further increasing the effect of relative variations in current density. In addition, it has been demonstrated that the pieces which are temporarily free from electric contact constitute dipoles in the electrolyte and that the metal of the anodic portion thereof tends to redissolve. This phenomenon thus further increases the thickness variations of the deposit.

It is already known that adding some mild reducing agents to aurocyanide electroplating baths, e.g., hydrazine or hydroxylamine and derivatives thereof substituted by organic groups (German DPS 1,215,467; 1,218,248; 1,222,347; UPS 3,770, 596; 3,783,111), tends to cancel the "dipole effect" mentioned above.

It is also known that some complexing agents such as, for instance, N-carboxymethyl-polyamines or N-phosphonylmethylpolyamines, namely ethylene diamine tetraacetic acid, EDTA (German DOS 2,220,621 [DEGUSSA], USP 3,783,111 [AURIC] and ethylene diamine tetramethylphosphonic acid, EDTP (UPS 3,770,596 [AURIC] can obviate the difficulties resulting from current density variations and improve the plating distribution. Said complexors also have the property of slowing down or preventing the co-deposition with the gold of certain metal impurities which may be present in the bath.

It is also known that the levelling power of a gold and gold-alloy plating bath is improved by adding, among other ingredients, an aldehyde and a polyamine substituted or unsubstituted, the aliphatic or aromatic substituents of which can comprise hydroxy groups, the effective quantity of such compound being comprised between 0.1 and 50 g/l of the plating solution (German DOS 2,244,434 [SCHERING]).

Finally, it is also known that the addition of water soluble arsenic compounds to gold plating baths improves the surface structure of the deposits and makes them more shiny and less porous (German DPS 2,042,127 [SEL-REX[, USP 3,423,295 [ENGELHARD]). It is, of course, desired to maintain the arsenic concentration as low as possible for various reasons such as safety. According to some Electronic Industry specifications, the concentration of arsenic in the bath will not be permitted to exceed a few mg/l.

It has now been found that none of the foregoing baths were satisfactory for the pure gold (practically 24 carat) barrel plating of some pieces used in said electronic industry. The distribution capacity of the baths comprising a reducing amine, a complexing agent and arsenic was not sufficient. In contrast, the platings obtained from baths containing an aldehyde, a polyamine in concentration above 0.1 g/l, a reduced amine and a small amount of arsenic has a tendency to discolor with heat. Such discoloration of surface decomposition constitutes a fundamental drawback for electronic applications since the plated pieces cannot be properly soldered. While this difficulty could be removed by increasing the arsenic content in the bath, the aresenic level in the deposits was too high to be acceptable.

SUMMARY OF THE INVENTION

It has now been discovered that the desired results could be obtained by deleting the aldehyde and by lowering the polyamine concentration below 0.1 g/l.

Hence, the electroplating bath of the present invention contains gold in the form of an auro-cyanide complex, at least one mild reducing agent, at least one complexing agent, small quantities of a water-soluble arsenic compound and at least one substituted polyamine of the formula:

$$R_2N\,(R'\,NR)_m\,R'\,NR_2$$

wherein at least one R group is an aliphatic or aromatic radical having 1 to 6 carbon atoms or hydroxy derviative thereof, and the remaining R groups, if any, are hydrogen; R′ is an alkylene radical of 1 to 5 carbon atoms or a hydroxy derivative thereof; and *m* is equal to 0, 1 or 2, the polyamine being present in the amount such that the weight ratio of polyamine/As is between 1 and 5/1.

DETAILED DESCRIPTION OF THE INVENTION

For most applications, the arsenic concentration will preferably be comprised between 1 and 20 mg/l although, in some cases, concentrations as low as 0.1 mg/l can still be useful; consequently, the concentration of the substituted polyamine will preferably be from 1 to 100 mg/l. However, the most favorable concentration in a given bath will depend on the particular gold bath composition and also, on the particular structure of the amines selected.

Even with concentrations as low as about 1 to 5 mg/l, a mixture of hydroxylated amines can have a profound levelling effect on the metal distribution of the deposits. It will, however, be noted that in some special applications, for instance when it is desired to obtain very bright and hard gold deposits comprising higher levels of arsenic (e.g. above 50 ppm), it will be possible to incorporate in the present bath up to 1 g/l of arsenic in the form of water-soluble compounds. In such cases, the amount of polyamine can be raised up to about 5 g/l but still within the above-mentioned limits of the weight-ratio polyamine/As without experiencing difficulties.

As water-soluble arsenic compounds, one can use, for instance, $As_2O_3$ and alkali and ammonium arsenites, and more generally, all water-soluble arsenic compounds which are stable at a pH of 5 to 10.

The gold concentration of the present bath is preferably comprised between 2 and 100 g/l, better between 6 and 12 g/l. In some cases, the bath may contain alloying metals, e.g., Ni, Co, Fe, In, Sn, Zn, etc., in the form of their commonly used water-soluble compounds (salts, chelates, organic complexes, etc.) at the concentrations commonly used in the art of gold-alloy plating.

As mild reducing agents, the reducing amine derivatives are preferred. One can use hydrazine in its basic form (hydrazine hydrate) or its common salts with mineral or organic acids (e.g., hydrochloride, sulfate, phosphate, etc.). Other related derivatives of hydrazine or hydroxylamine such as those described in German DPS 1,218,248 can also be used. Other similar compounds such as piperazine (see for instance GB Pat. No. 1,156,186), N,N-diaminopiperazine, guanidine and their water-soluble derivatives can also be used. The concentrations of the reducing agent, hydrazine for example, can be comprised between 2 and 100 g/l (calculated as hydrazine hydrate).

With regard to the complexing agents, one can use most chelating agents commonly used in gold baths, for instance EDTA, nitrilotriacetic acid (NTA), diethylene-triamine pentaacetic acid (DTPA), corresponding methane phosphonic compounds and related substances known in the field as chelating agents for metals (see for instance ROBERT L. SMITH, the sequestration of Metals, Chapman & Hall, Ltd., London 1959; patents — U.S. Pat. No. 2,635,112 [RESEARCH CORP.]; 3,475,293 [MONSANTO]; German DOS 1,621,128 [LEO-RONAL]). The water-soluble salts and esters of these acids may also be employed.

The quantities of these complexing agents in the present bath can vary between wide limits. When practically pure gold (e.g. approximately 24 carat) must be deposited, relatively large quantities of EDTA or its methylphosphonic analog, e.g., about 50 to 150 g/l or more, can be used. When one wants to plate alloys which contain a high level of gold and a few percent of a base metal, e.g., Ni or Co, the quantity of complexing agent will have to be lower so as not to completely prevent the co-deposition of the base metal. In such cases, the concentration of the chelatant can be as low as a few g/l, e.g., from 1 to 50 g/l, the selected concentration being actually dependent on the amount of the foreign metal dissolved in the bath.

As polyamines, one will preferably use the hydroxy-compounds which result from the condensation of a polyamine (having 2 to 5 N atoms), substituted or not, with an epihalohydrin, preferably epichlorohydrin, the oxirane group thereof being hydrolyzed simultaneously or subsequently. Among the amines suitable for such condensation, the following can be mentioned: ethylene diamine, N-(hydroxyethyl)-ethylene diamine, N,N'-dihydroxyethyl)-ethylene diamine and corresponding derivatives from diethylene triamine, triethylene tetramine and tetraethylene pentamine.

Other suitable amines are listed below:

3-Dimethylamineo-1-propylamine; 3-morpholino-1-propylamine; N-(2-hydroxyethyl)-1,3-diaminopropane; N,N'-bis(2-hydroxyethylene diamine; N,N'-bis(2-hydroxyethyl)-1,3-diaminopropane; N-(2-hydroxyethyl)-priperazine; N,N,N'-trimethylethylenediamine; N,N,N''-trimethyldiethylenetriamine;N,N-dimethyldiethylenetriamine.

The condensation product results from the reaction of one molecule of amine, preferably N-(hydroxyethyl)-ethylenediamine, with preferably 1 to 2.5 moles of epichlorohydrin. Consequently, the condensation product will generally consist of a mixture of mono- and poly-substituted amino-products the substituents of which are derived from epichlorohydrin. The mixture can also contain polymers which result from the reaction of the amino-groups with both reactive carbon atoms of epichlorohydrin (namely the halogenated and oxirane carbon atoms). It was, however, noticed after isolation of the high molecular weight condensation products, that these products has a negligible effect on the plating properties of the electrolytic bath but at least they were not harmful. Briefly summarized, the active products with relatively low molecular weight of the above mixture will mainly have the following schematic structure (calling A the amine and B the epichlorohydrin moieties) : AB, BAB, $B_2A$, $B_2AB$, BABA, etc.. Although all such compounds have been found in the mixture in variable proportions and identified by VPC, they have been preparatively separated and individually tested in plating baths. In the present invention, only the crude condensation reaction mixture of products is used including the inactive high molecular weight compounds.

Thus, in general, the crude aqueous reaction mixture was used as such, without further purification, as the additive for the gold baths. It was found that in such mixtures, most of the oxirane groups were hydrolyzed to hydroxy-groups.

It should be further remarked that if one incorporates into the present gold bath a quantity of the polyamine mixture which exceeds the limit of 0.05 to 0.1 g/l, without proportionally raising the arsenic concentration, the gold desposits can become thermally unstable exhibiting poor solderability.

It should also be remarked that the present baths can further contain conducting and/or buffering salts or mixtures generally used in gold electroplating baths for increasing the conductivity and the stability of such baths to pH variations. As such products, the following can be mentioned, for example, alkali metal and ammonium acetates, sulfates, phosphates, etc. (acid and neutral salts), ammonium and alkali metal borates, phthalates, tartrates, citrates, etc.

The present bath can be favorably operated at a pH of between 6 and 10, preferably between 6.5 and 8 (near neutral) under current densities of 0.1 to 4 A/dm$^2$ and at a temperature between about 35° and 75° C., preferably between 50° and 60° C.

The use of the present bath for the plating of small electronic components and parts comprises the barrel-electroplating of said parts by means of conventional plating barrels.

The following examples illustrate the invention in more detail. In said examples, all parts are by weight unless specified otherwise.

EXAMPLE I

An electrolytic gold bath was prepared by dissolving together in water the following components.

| Component | Conc. (G/L) |
|---|---|
| Gold (as $KAu(CN)_2$) | 6 |

-continued

| Component | Conc. (G/L) |
|---|---|
| EDTA | 100 |
| $K_2HPO_4$ | 150 |
| Hydrazine hydrate (conc. $H_2O$ sol.) | 20 ml |
| Dil. KOH to adjust ph to | 7.5 |

The above composition was divided into three portions A, B and C of 35-1 each. Portion A was completed by adding thereto enough $As_2O_3$ to achieve an As concentration of 5 mg/l; B was completed by adding thereto 8 mg/l (calculated as a solid) of a hydroxylated polyamine mixture the preparation of which is given hereinafter and C was completed by adding thereto both the arsenic and the amine at the same concentrations used for A and B.

Now, three series each of 1250 transistor headers (Type TO-18) were barrel plated by means of solutions A, B anc C under the following conditions: 50° C., 0.2 A/dm², 20 min. Twenty-five pieces were selected at random from each of the above lots and the following thickness of deposit measurements were carried out on each piece: Plating thickness on the head (H), on the ground wire (GW) and on the ungrounded isolated wire (IW). The cumulated mean values of each series of measurements were calculated according to usual statistical calculation methods; the results are shown in the Table below:

| | THICKNESS (MICRONS) | | | |
|---|---|---|---|---|
| BATH | MEAN (H) | MEAN (GW) | MEAN (IW) | MEAN (H) minus MEAN (IW) |
| A | 2.96 | 2.71 | 1.29 | 1.67 |
| B | 2.82 | 2.51 | 1.68 | 1.14 |
| C | 2.58 | 2.95 | 1.72 | 0.86 |

From the above results, mean (H) — mean (IW), it can be seen that the simultaneous presence of As and the polyamine achieves the optimum plating distribution. The plating is semibright, deep yellow, faultless and its solderability is excellent. Its arsenic content is around 40 ppm.

The mixture of amines used in the present example for improving the plating distribution was prepared as follows:

One mole (104g) of N-(2-hydroxyethyl)-ethylene diamine was dissolved in 600 ml of water. Then, one mole (92.5g) of epichlorohydrin was added dropwise at room temperature under stirring and while controlling the pH at 9 with aqueous NaOH. Then, under the same conditions, except for the temperature which was raised to 50° C., another 1.5 mole (137g) of epichlorohydrin was added dropwise at constant pH. The mixture was stirred another hour at 50° C., then it was neutralized down to pH 6.5 with diluted aqueous $H_2SO_4$ and the excess of epichlorohydrin was evaporated off under the reduced pressure (20 mm, 40° C.). Then the residual mixture was diluted with distilled water to make 1800 ml. This solution which contained 200 g of solids/l was directly used as an additive for the present gold bath.

The polyamine condensation product mixture was subjected to gel permeation chromatography on "SEPHADEX" (purchased from Pharmacia AB, Uppsala, Sweden) using water as the eluent, the flow of eluate was monitoring by UV-visible spectrometry and by refractometry according to usual means and was divided into three main fractions numbered 1 to 3 (each corresponding to separate peaks in the spectrum) and having approximate percent distribution: (1) 20%, (2) 75%, and (3) 5%.

The water of each fraction was removed under reduced pressure and a portion of the resulting concentrates was subjected to elemental analysis and molecular weight determination. The results showed that fractions (1) and (2) consisting in mixtures of polyamines having structures to be expected from the condensation of N-(2-hydroxyethyl)-ethylene diamine with an excess of epichlorohydrin. Fraction (1) had a MW above approximately 500, and (2) was between 50-100 and approximately 500. Further samples of fractions (1) and (2) were subjected to VPC according to usual means which confirmed the above results and revealed the presence of compounds of the types mentioned in the earlier description. Finally, fraction (1) and (2) were tested for utility in the gold bath and under the conditions of this example. Fraction (2) was the most effective, whereas fraction (1) was nearly useless.

When the other amines of the foregoing description were used in place of the N-(2-hydroxyethyl) ethylene diamine in the above preparation, products with comparable effects upon the gold bath were obtained.

EXAMPLE II

An electroplating gold bath was prepared as described in Example 1 by using the following:

| Component | Conc. (G/L) |
|---|---|
| Gold (as $KAu(CN)_2$) | 8 |
| Ethylenediaminetetra (methylenephosphonic) acid | 140 |
| Hydrazine hydrate (as the concentrated commercial $H_2O$ solution) | 10 |
| Aqueous KOH to adjust the pH to | 7.2 |

The above composition was divided into four baths numbered (1), (2), (3) and (4) respectively. Then As (3.5 mg/l) as $As_2O_3$ and the mixture of polyamines obtained according to Example I (5 mg/l) were added separately or together to the above fractions in accord with the following table:

| | Bath Concentration mg/l | | | |
|---|---|---|---|---|
| Component | 1 (control) | 2 | 3 | 4 |
| As | 0 | 3.5 | 0 | 3.5 |
| Polyamine | 0 | 0 | 5.0 | 5.0 |

The plating properties of fractions 1 to 4 were thereafter experimented by using Hull cells according to usual means under the following conditions: 55° C., pH 7.2, 3 min., strong agitation, range of current densities: 0 to 5 A/dm². The results on the deposits obtained from baths (1), (2), (3) and (4) are listed below:

1. brownish, rough, irregular and useless.
2. semi-bright, yellow up to 1 A/dm²; above, rough and irregular.
3. brownish and irregular, unsatisfactory.
4. semi-bright, yellow, excellent soldering performances up to 4 A/dm².

The results of this Example parallel those of Example I.

EXAMPLE III

Transistor headers (TO-18) were barrel plated under the conditions derived from Example II (55° C., pH 7.2, average current density 0.5 A/dm² for a period of time sufficient for obtaining 2–3 μ coatings average thickness) using as baths: A) a solution identical to bath (4) in Example II; B) a solution as in Example II but containing 5 mg/l of As and 1 g/l of the mixture of polyamines.

The plated pieces which initially were undistinguishable were heated for 30 minutes in an oven heated to 500° C. It was thereafter noted that the pieces plated with (A) had kept unchanged while these plated with (B) had discolored badly, demonstrating the importance of maintaining the proper weight ratio of polyamine-/As.

What is claimed is:

1. An aldehyde-free aqueous bath having a pH of from about 5 to 10 for the electrodeposition of gold and its alloys containing gold as the aurocyanide complex, a mild reducing agent selected from the groups consisting of hydrazine, hydroxylamine, piperazine, guanidine, and the organic substituted derivatives thereof, a complexing agent selected from the group consisting of N-methylcarboxylated and N-methylphosphonylated amines, from 1 to 20 mg/l arsenic as a water-soluble arsenic compound, and from 1 to 100 mg/l of a substituted polyamine of formula $$R_2N(R—NR)_m—R'—NR_2$$

at least one R group is an aliphatic or aromatic radical having 1 to 6 carbon atoms or hydroxy derivative thereof, and the remaining R groups, if any, are hydrogen; R′ is an alkylene radical of 1 to 5 carbon atoms or a hydroxy derivative thereof and *m* is equal to 0, 1 or 2, the polyamine being present in an amount such that the weight ratio of polyamine/AS is between 1 and 5/1.

2. The bath of claim 1 which comprises 6–12 g/l of gold, 2-100 g/l of hydrazine as reducing agent, and 1 to 150 g/l of the complexing agent.

3. The bath of claim 1 wherein the polyamine is a mixture resulting from the condensation of N-(hydroxyethyl)-ethylene diamine with epichlorohydrin and hydrolysis of the oxirane function.

4. A process for obtaining a gold deposit of improved uniformity of deposit thickness on an irregularly shaped conductive surface comprising electrolyzing the bath of claim 1 with said surface as cathode.

* * * * *